US005388723A

United States Patent [19]

Kampmeyer

[11] Patent Number: 5,388,723

[45] Date of Patent: Feb. 14, 1995

[54] RANDOM MEMBER DISPENSER

[76] Inventor: John J. Kampmeyer, 2221 Iona Dr., Cocoa, Fla. 32926

[21] Appl. No.: 205,648

[22] Filed: Mar. 4, 1994

[51] Int. Cl.[6] ..... G07F 11/46

[52] U.S. Cl. ..... 221/186; 221/190; 221/199; 221/204

[58] Field of Search ..... 221/199, 200, 204, 151, 221/152, 186, 188, 189, 190, 191, 194

[56] References Cited

U.S. PATENT DOCUMENTS 868,632 10/1907 Almstrom ..... 221/200
2,134,180 10/1938 Felber ..... 221/200
2,256,340 9/1941 Gora et al. ..... 221/190 X
4,230,236 10/1980 Boulter ..... 221/200 X

*Primary Examiner*—Robert P. Olszewski
*Assistant Examiner*—Dean A. Reichard

[57] ABSTRACT

A device for randomly dispensing one of a plurality of discrete random members. The device includes a housing having a cavity within which the random members may be contained. The housing is supported by a pair of supporting actuators which cooperate to open an aperture in the cavity when the housing is downwardly pushed by a user. A random member is thereby allowed to escape from the housing for generating random numbers such as utilized in bingo, lotteries, and other games. Preferably, the housing is shaped as an animal, such as a chicken, turkey, or the like.

5 Claims, 4 Drawing Sheets

RANDOM MEMBER DISPENSER

BACKGROUND OF THE INVENTION

1. Field of the Invention

The present invention relates to dispensers and more particularly pertains to a random member dispenser for randomly dispensing one of a plurality of discrete random members.

2. Description of the Prior Art

The use of dispensers is known in the prior art. More specifically, dispensers heretofore devised and utilized for the purpose of generating random numbers are known to consist basically of familiar, expected and obvious structural configurations, notwithstanding the myriad of designs encompassed by the crowded prior art which have been developed for the fulfillment of countless objectives and requirements.

For example, a candy dispenser is disclosed in U.S. Pat. No. 4,978,030 which includes a candy container configured as a fowl or the like with the candy being shaped as an egg. Squeezing or compressing the container causes an egg to be ejected from an orifice on the bottom of a container, while simultaneously generating air pressure to activate a reed type sound generator located in the bill of the container.

A random number generator is illustrated in U.S. Pat. No. 5,039,101 which may be utilized for selecting a specific quantity of random numbers from a preselected quantity of numbers for a select game of chance. This device includes a container which is substantially filled with a plurality of spheres and a liquid. These spheres are buoyant relative to the liquid, such that a selected quantity of these spheres may float into a tube, whereby they may be selected therefrom as random numbers.

Another patent of interest is U.S. Pat. No. 4,974,847 which describes a lottery pick machine designed for mixing number balls within a closed container. The container has an entry port for the insertion of the balls and an exit port for the exit of the balls after they have been mixed and randomly selected. The machine may be used for any game or function that requires mixing of numbers, but the main purpose of the machine is for the random selection of numbers for the various lottery games that are now popular around the country.

Other known prior art dispensers utilized for random number selection are disclosed in U.S. Pat. No. 4,877,246, and U.S. Pat. No. 3,466,045.

While these devices fulfill their respective, particular objectives and requirements, the aforementioned patents do not disclose a random member dispenser for randomly dispensing one of a plurality of discrete random members which includes a housing having a cavity therewithin and being supported by a pair of supporting actuators which cooperate to open an aperture in the cavity when the housing is downwardly pushed by a user such that a random member is thereby allowed to escape from the housing for generating random numbers such as utilized in bingo, lotteries, and other games. Furthermore, none of the known prior art dispensers teach or suggest a random member dispenser of the aforementioned structure in which the housing is shaped as an animal, such as a chicken, turkey, or the like.

In these respects, the random member dispenser according to the present invention substantially departs from the conventional concepts and designs of the prior art, and in so doing provides an apparatus primarily developed for the purpose of randomly dispensing one of a plurality of discrete random members.

SUMMARY OF THE INVENTION

In view of the foregoing disadvantages inherent in the known types of dispensers now present in the prior art, the present invention provides a new random member dispenser construction wherein the same can be utilized for randomly dispensing one of a plurality of discrete random members. As such, the general purpose of the present invention, which will be described subsequently in greater detail, is to provide a new random member dispenser apparatus and method which has many of the advantages of the dispensers mentioned heretofore and many novel features that result in a random member dispenser which is not anticipated, rendered obvious, suggested, or even implied by any of the prior art dispensers, either alone or in any combination thereof.

To attain this, the present invention generally comprises a device for randomly dispensing one of a plurality of discrete random members. The device includes a housing having a cavity within which the random members may be contained. The housing is supported by a pair of supporting actuators which cooperate to open an aperture in the cavity when the housing is downwardly pushed by a user. A random member is thereby allowed to escape from the housing for generating random numbers such as utilized in bingo, lotteries, and other games. Preferably, the housing is shaped as an animal, such as a chicken, turkey, or the like.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new random member dispenser apparatus and method which has many of the advantages of the dispensers mentioned heretofore and many novel features that result in a random member dispenser which is not anticipated, rendered obvious, suggested, or even implied by any of the prior art dispensers, either alone or in any combination thereof.

It is another object of the present invention to provide a new random member dispenser which may be easily and efficiently manufactured and marketed.

It is a further object of the present invention to provide a new random member dispenser which is of a durable and reliable construction.

An even further object of the present invention is to provide a new random member dispenser which is susceptible of a low cost of manufacture with regard to both materials and labor, and which accordingly is then susceptible of low prices of sale to the consuming public, thereby making such random member dispensers economically available to the buying public.

Still yet another object of the present invention is to provide a new random member dispenser which provides in the apparatuses and methods of the prior art some of the advantages thereof, while simultaneously overcoming some of the disadvantages normally associated therewith.

Still another object of the present invention is to provide a new random member dispenser for randomly dispensing one of a plurality of discrete random members.

Yet another object of the present invention is to provide a new random member dispenser which includes a housing having a cavity there within for containing a plurality of discrete random members in which the housing is supported by a pair of supporting actuators which cooperate to open an aperture in the cavity when the housing is downwardly pushed by a user such that a random member is thereby allowed to escape from the housing.

Even still another object of the present invention is to provide a new random member dispenser of the aforementioned structure in which the housing is shaped as an animal, such as a chicken, turkey, or the like.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
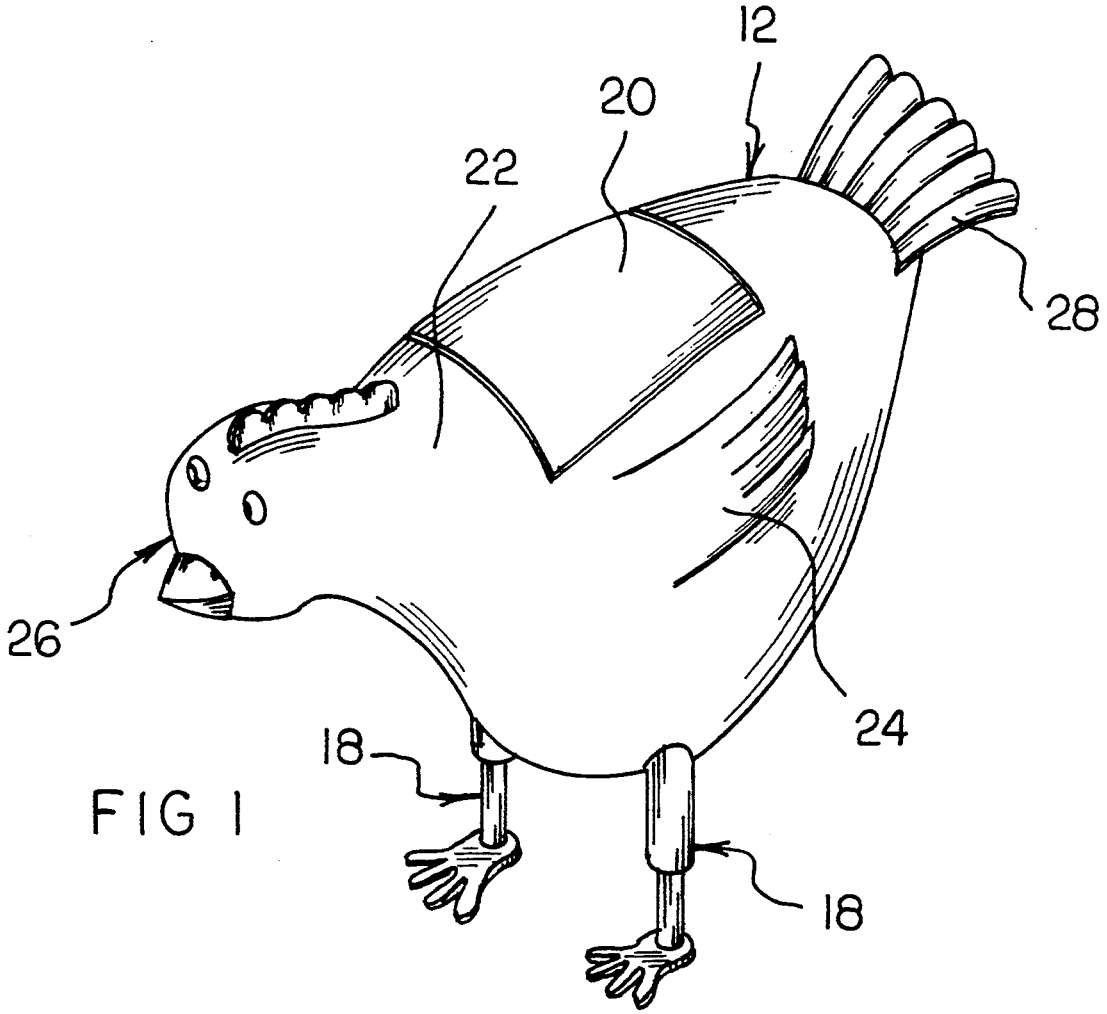
FIG. 1 is a perspective view of a random member dispenser according to the present invention.

With reference now to the drawings, and in particular to FIGS. 1–8 thereof, a new random member dispenser embodying the principles and concepts of the present invention will be described.

From an overview standpoint, the random member dispenser comprises a housing 12 having an internal cavity 14 within which a plurality of random members 16 may be stored. A pair of supporting actuators 18 support the housing 12 in an elevated position relative to a ground surface. Upon a depression of the housing 12 downwardly against a force of the supporting actuators 18, one of the random members 16 will thereby be dispensed.

In use, the random member dispenser may be utilized to dispense any type of member in a random manner, such members including lottery balls, candy, or the like. Regardless of the type of member 16 being dispensed, the members are positioned within the cavity 14, whereby agitation of the housing 12 may be accomplished through a shaking of the same. The supporting actuators 18 may then be engaged to an object such as a ground surface or the like, whereby a biasing of the housing 12 towards such surface will result in the dispensing of one of the members 16 from the housing 12.

Figure 2:
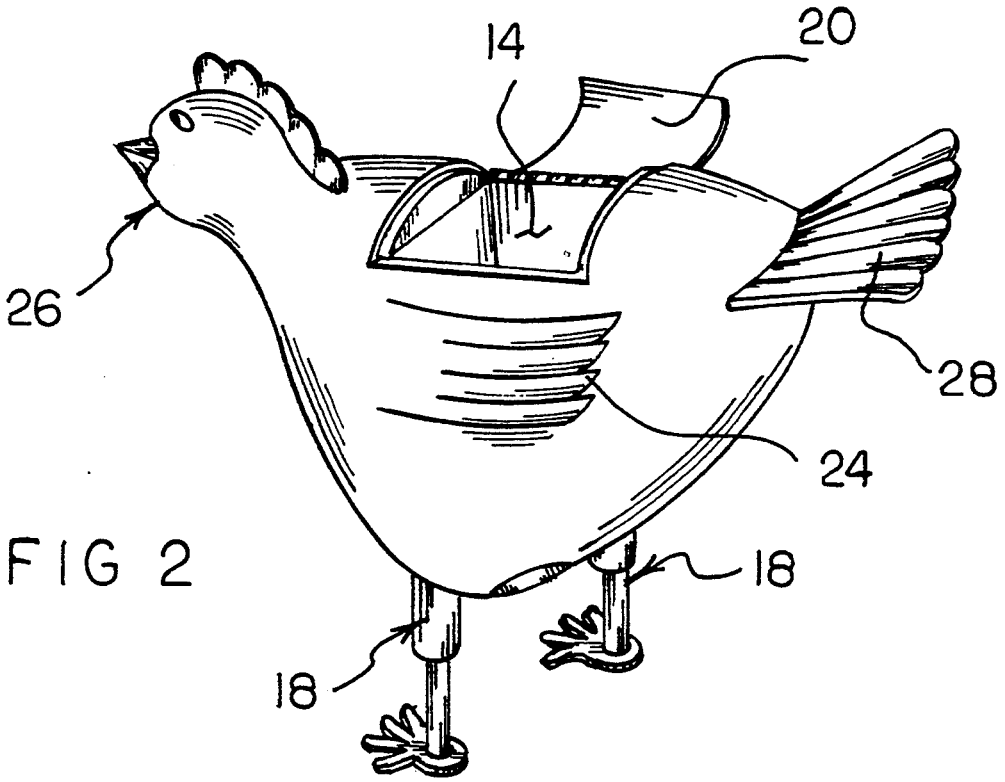
FIG. 2 is a further perspective view of the present invention.
Figure 7:
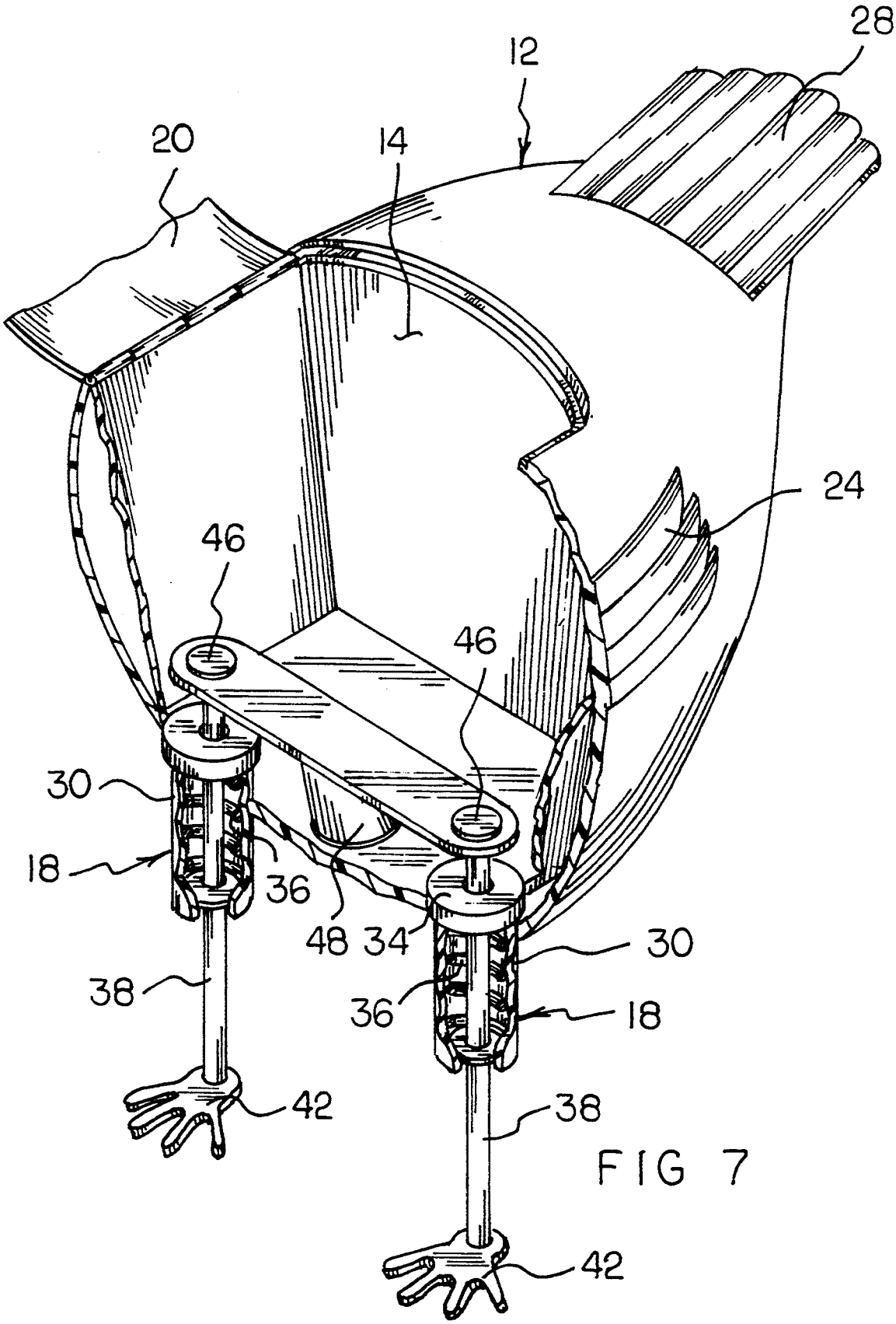
FIG. 7 is a perspective view, partially in cross section, of the present invention.

More specifically, it will be noted that the random member dispenser 10 comprises a housing 12 defining a cavity 14 therewithin, as best illustrated in FIGS. 2 and 7. The housing 12 is provided with an access door 20 which allows for the placement of a plurality of random members 16 within the cavity 14. In the preferred embodiment, the housing 12 is shaped so as to define a chicken body 22 having a pair of chicken wings 24 located on opposite sides thereof. In addition, the chicken body 22 is provided with a pair of handles which take the form of a chicken head 26 and a chicken tail 28. The handles 26, 28 may be utilized to grasp and manipulate the housing 12 to agitate and subsequently dispense the random member 16 from within the cavity 14.

The housing 12 is supported upon a pair of supporting actuators 18, as best illustrated in FIGS. 1 and 2. In the preferred embodiment, the supporting actuators 18 are shaped so as to resemble a pair of chicken legs which cooperate to support and balance the chicken body 22 in the standing position shown in the drawings. As best illustrated in FIG. 7, it can be shown that each of the supporting actuators 18 comprises a substantially hollow cylinder 30 which is fixedly secured to the housing 12 and positioned in communication with the cavity 14. Each cylinder 30 includes both a cylinder floor 32 and a cylinder cap 34 which cooperate to confine a coil spring 36 within the cylinder 30. Both the floor 32 and the cap 34 include a through-extending aperture which allow a rod 38 to be telescopically received within the cylinder 30 and into the cavity 14. The rod 38 is provided with a spring abutment plate 40 which engages a lower end of the coil spring 36, thereby capturing the spring between the abutment plate and the cap 34. A supporting base 42 is secured to a distal end of the rod 38 and provides a surface suitable for placement upon a table surface, or the like.

Figure 8:
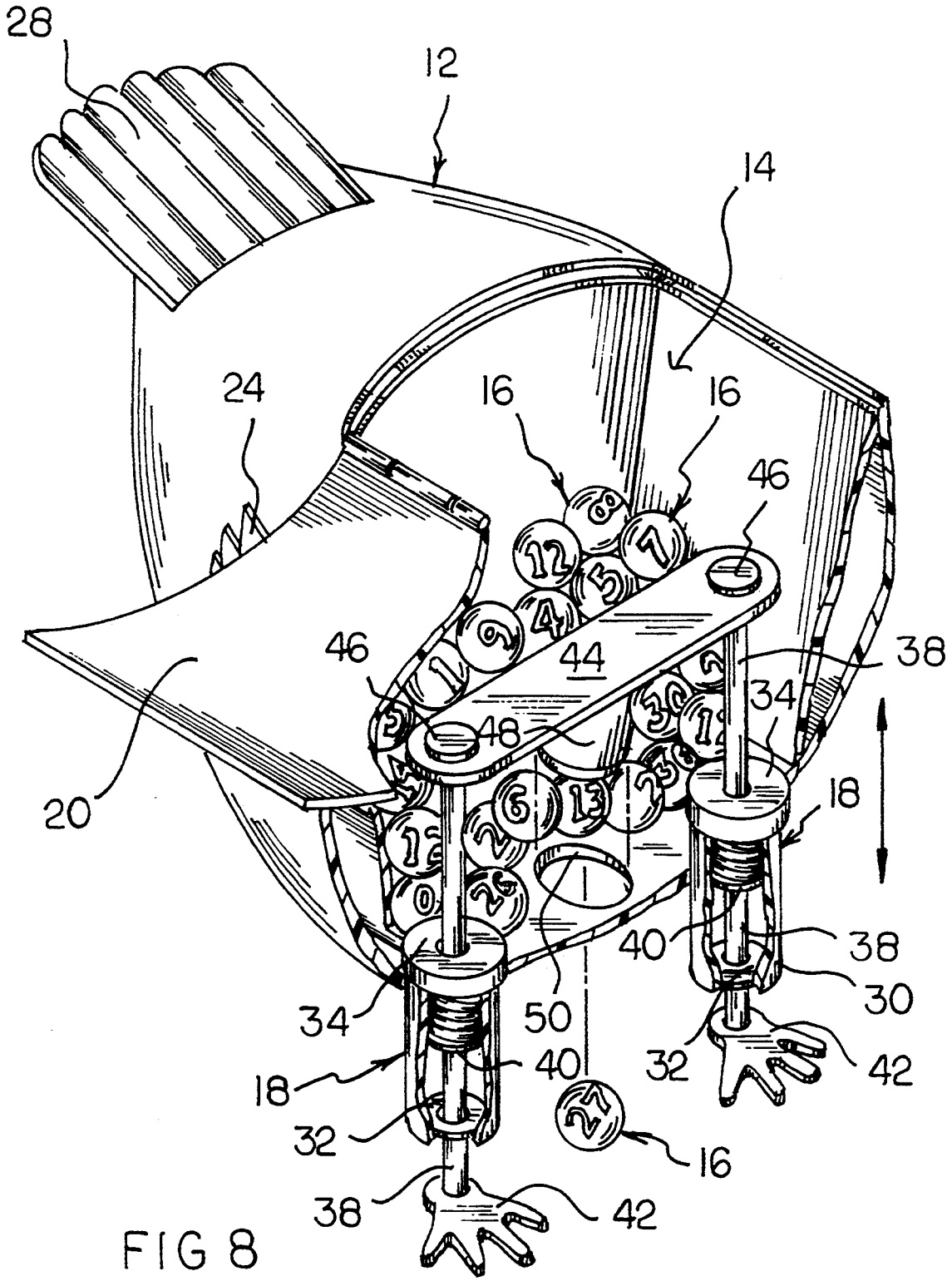
FIG. 8 is a further perspective view, partially in cross section, of the present invention illustrating a plurality of random members present therewithin.

The supporting actuators 18 are arranged in a substantially parallel, spaced relation and project from a bottom of the housing 12 to support the housing in a spaced relationship relative to a supporting surface. Positioned within the cavity 14 is a cross plate 44 which extends between the proximal ends of the rods 38 and is secured to each respective rod by a rivet 46. The cross plate 44 supports a plug 48 which projects through an aperture 50 within the housing 12, as best illustrated in FIG. 8. By this structure, the housing 12 may be biased downwardly by the application of a pushing force by a user, whereby the rods 38 will be received within the cavity 14 against the force of the coil springs 36 to lift the cross plate 44 and its associated plug 48 from the aperture 50 to dispense one of the random numbers 16 contained within the cavity 14.

Figure 3:
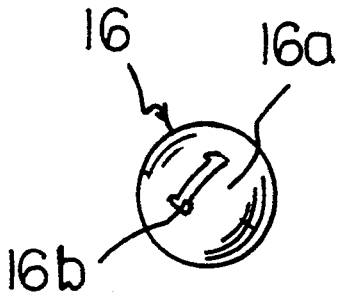
FIG. 3 is an orthographic view of a random member comprising the present invention.
Figure 4:
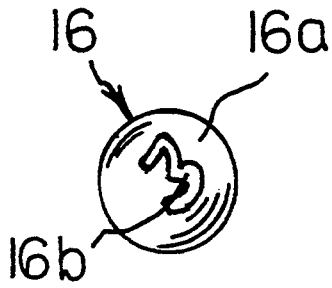
FIG. 4 is an orthographic view of a further random member comprising the present invention.
Figure 5:
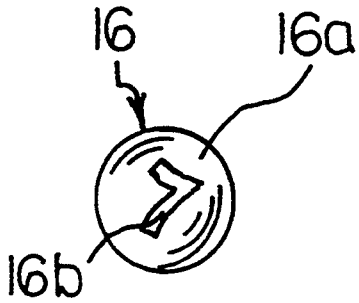
FIG. 5 is an orthographic view of another random member comprising the present invention.
Figure 6:
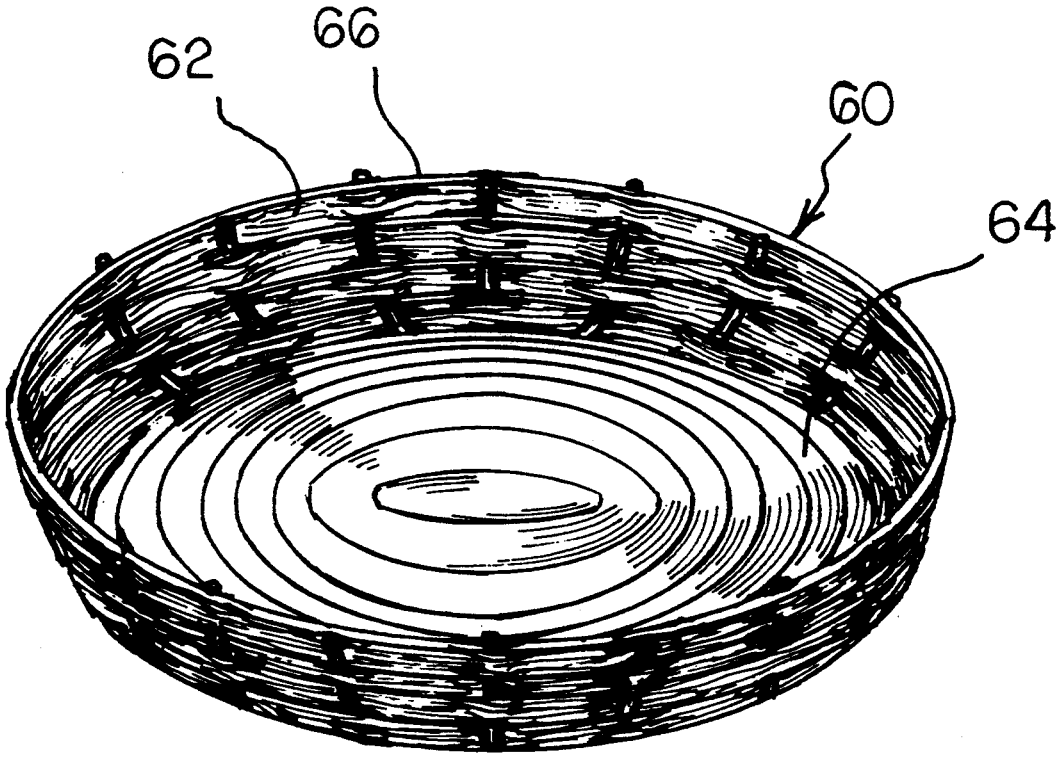
FIG. 6 is a perspective view of a nest forming a portion of the present invention.

Turning now to FIGS. 3, 4, and 5, it can be shown that the random member 16 may comprise a plurality of balls 16*a* each having disparate indicia 16*b* thereon. However, it is within the intent and preview of the present invention to include random members 16 of other shapes and forms, such as candy and the like. In addition, the present invention may also include a nest 60 formed of wicker 62 and shaped so as to define a floor 64 and a sidewall 66 extending circumferentially therearound. The nest 60 is operable to capture and retain a dispensed random member 16 and should be of a size sufficient to allow placement of the supporting actuators 18 within the nest upon the floor 64.

In use, the random member dispenser may be utilized to dispense any type of member in a random manner, such members including lottery: balls, candy, or the like. Regardless of the type of member 16 being dispensed, the members are positioned within the cavity 14, whereby agitation of the housing 12 may be accomplished through a shaking of the same. The supporting actuators 18 may then be engaged to an object such as a ground surface or the like, whereby a biasing of the housing 12 towards such surface will result in the dispensing of one of the members 16 from the housing 12.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new random member dispenser comprising:

a housing having an internal cavity with a cavity aperture extending from said internal cavity to an exterior of said housing;

at least one supporting actuator means for supporting said housing in an elevated position above a surface, said supporting actuator means further being operable to dispense a random member from said cavity through said cavity aperture upon an application of a downward force to said housing; said at least one supporting actuator means comprising a pair of supporting actuators mounted on opposed sides of said cavity aperture.

2. The random member dispenser of claim 1, wherein each supporting actuator comprises a hollow cylinder secured to said housing and in communication with said cavity, said cylinder having a floor and a cap, with said floor and said cap each having an aperture therethrough; a rod having a proximal end, a distal end, and a medial portion thereof, said rod being telescopically received within said cylinder; a supporting base secured to said distal end of said rod; a spring abutment plate secured to said medial portion of said rod within said cylinder; and a spring captured between said cap and said abutment plate.

3. The random member dispenser of claim 2, wherein said pair of supporting actuators comprises a first supporting actuator and a second supporting actuator; and further comprising a cross plate having first and second ends, said first end being secured to said rod of said first supporting actuator and said second end being secured to said rod of said second supporting actuator; and a plug coupled to said cross plate and received within said cavity aperture.

4. The random member dispenser of claim 3, wherein said housing comprises a chicken body having a chicken head and a chicken tail.

5. The random member dispenser of claim 4, wherein said chicken tail and said chicken head operate as handles.

* * * * *